US009255459B2

(12) United States Patent
Wilie

(10) Patent No.: US 9,255,459 B2
(45) Date of Patent: Feb. 9, 2016

(54) COLLAPSIBLE CASING DEVICE FOR USE IN CONTROLLING FLOW

(75) Inventor: Curtis Len Wilie, Alvin, TX (US)

(73) Assignee: Shell Oil Company, Houston, TX (US)

( * ) Notice: Subject to any disclaimer, the term of this patent is extended or adjusted under 35 U.S.C. 154(b) by 34 days.

(21) Appl. No.: 13/881,652

(22) PCT Filed: Oct. 28, 2011

(86) PCT No.: PCT/US2011/058925

§ 371 (c)(1),
(2), (4) Date: Apr. 25, 2013

(87) PCT Pub. No.: WO2012/058544

PCT Pub. Date: May 3, 2012

(65) Prior Publication Data

US 2013/0214183 A1 Aug. 22, 2013

Related U.S. Application Data

(60) Provisional application No. 61/408,132, filed on Oct. 29, 2010.

(51) Int. Cl.
*F16K 17/36* (2006.01)
*F16K 7/20* (2006.01)
(Continued)

(52) U.S. Cl.
CPC ..... *E21B 33/06* (2013.01); *E21B 29/02* (2013.01); *E21B 29/08* (2013.01); *E21B 34/06* (2013.01); *E21B 43/12* (2013.01)

(58) Field of Classification Search
CPC ..... E21B 33/06; E21B 29/02; E21B 29/08; E21B 34/06; E21B 43/12; Y10T 137/1647
USPC ..... 137/68.13; 251/5, 4, 1.1; 166/317, 376; 1/68.13
See application file for complete search history.

(56) References Cited

U.S. PATENT DOCUMENTS 2,573,712 A * 11/1951 Kallam ..... 251/5
3,242,939 A * 3/1966 Fogg ..... 137/67
(Continued)

FOREIGN PATENT DOCUMENTS

JP 05059880 3/1993
WO WO9110039 7/1991

OTHER PUBLICATIONS

PCT International Search Report, Application No. PCT/US2011/058295 dated Mar. 16, 2012.

*Primary Examiner* — John K Fristoe, Jr.
*Assistant Examiner* — Minh Le

(57) ABSTRACT

A collapsible casing device, comprising an insert housing, said insert housing having an outer surface and an inner surface, said outer surface fluidly isolated from an external environment, said inner surface having a profile, and a connection between said outer surface and said inner surface, wherein said connection is capable of fluidly connecting to a tubular element; a deformable insert, said deformable insert having an inner surface and an outer surface, said outer surface fitting within said profile of said insert housing, said inner surface capable of containing a fluid and having a first inner diameter, said deformable insert having properties that are conducive to deformation; an explosive material that generates a pressure pulse in response to an activation signal, said explosive material having an inner surface and an outer surface and a composition, said outer surface fitting within said profile of said insert housing, said inner surface external to said outer surface of said deformable insert; and a trigger, said trigger capable of generating said activation signal.

14 Claims, 6 Drawing Sheets

(51) Int. Cl.

| | |
|---|---|
| ***E21B 33/06*** | (2006.01) |
| ***E21B 29/02*** | (2006.01) |
| ***E21B 29/08*** | (2006.01) |
| ***E21B 43/12*** | (2006.01) |
| ***E21B 34/06*** | (2006.01) |

(56) References Cited

U.S. PATENT DOCUMENTS

| | | | | | |
|---|---|---|---|---|---|
| 3,268,009 | A | * | 8/1966 | Bussey et al. | 169/16 |
| 3,277,964 | A | * | 10/1966 | Houpeurt et al. | 166/285 |
| 3,441,245 | A | * | 4/1969 | Holland et al. | 251/5 |
| 3,485,472 | A | * | 12/1969 | Bozich | 251/5 |
| 3,552,712 | A | * | 1/1971 | Whitlock | 251/5 |
| 3,766,803 | A | * | 10/1973 | Ball et al. | 74/625 |
| 3,771,601 | A | * | 11/1973 | Garrett | 166/297 |
| 3,955,594 | A | * | 5/1976 | Snow | 137/493 |
| 3,982,722 | A | * | 9/1976 | Bernard | 251/4 |
| 4,108,418 | A | * | 8/1978 | Ensign et al. | 251/5 |
| 4,111,391 | A | * | 9/1978 | Pilolla | 251/5 |
| 4,140,041 | A | * | 2/1979 | Frelau | 89/1.14 |
| 4,163,477 | A | | 8/1979 | Johnson et al. | 166/362 |
| 4,602,794 | A | | 7/1986 | Schaeper et al. | 277/235 |
| 4,811,758 | A | * | 3/1989 | Piper | 137/844 |
| 5,205,325 | A | * | 4/1993 | Piper | 137/844 |
| 5,251,702 | A | | 10/1993 | Vazquez | 166/324 |
| 5,253,585 | A | | 10/1993 | Hudak et al. | 102/311 |
| 5,253,704 | A | * | 10/1993 | Barrus et al. | 166/53 |
| 5,535,983 | A | * | 7/1996 | Hohermuth | 251/5 |
| 5,549,793 | A | * | 8/1996 | Hellstrom et al. | 162/258 |
| 5,931,442 | A | * | 8/1999 | Cummins | 251/1.1 |
| 6,102,361 | A | * | 8/2000 | Riikonen | 251/5 |
| 6,361,015 | B1 | * | 3/2002 | Warmerdam | 251/5 |
| 6,505,810 | B2 | * | 1/2003 | Abromaitis | 251/7 |
| 6,948,696 | B1 | * | 9/2005 | Aanonsen et al. | 251/4 |
| 7,354,026 | B2 | | 4/2008 | Urrutia | 251/1.3 |
| 7,607,634 | B2 | * | 10/2009 | Browne et al. | 251/4 |
| 7,779,760 | B2 | | 8/2010 | Konig | 102/476 |
| 8,012,134 | B2 | * | 9/2011 | Claude et al. | 604/246 |
| 2004/0033108 | A1 | * | 2/2004 | Raftis et al. | 405/37 |
| 2005/0067590 | A1 | * | 3/2005 | Bush | 251/4 |
| 2005/0092944 | A1 | * | 5/2005 | Patterson | 251/4 |
| 2006/0192159 | A1 | * | 8/2006 | Kopp | 251/5 |
| 2008/0083889 | A1 | * | 4/2008 | Raftis | 251/5 |
| 2011/0186757 | A1 | * | 8/2011 | Kawamura et al. | 251/5 |
| 2011/0297237 | A1 | * | 12/2011 | Blum | 137/1 |
| 2012/0049094 | A1 | * | 3/2012 | Molavi | 251/4 |

* cited by examiner

COLLAPSIBLE CASING DEVICE FOR USE IN CONTROLLING FLOW

PRIORITY CLAIM

The present application claims priority from PCT/US2011/058295, filed Oct. 28, 2011, which claims priority from U.S. provisional application 61/408,132, filed Oct. 29, 2010, which is incorporated herein by reference.

FIELD OF THE INVENTION

The invention is directed towards an apparatus for reducing a flow rate, particularly when the flow is an uncontrolled flow of produced fluids from a wellbore.

BACKGROUND

U.S. Pat. No. 5,253,585 discloses that a main charge of explosive is positioned symmetrically about a passageway-forming tubular member, such as a well pipe assembly. The charge is outwardly and radially spaced from the member and is coupled thereto by a dense medium, such as soil, which is adapted to transfer the produced explosive energy to the tubular member in the form of a pressure pulse applied by the medium. Initiation charges are supplied at the outer surface of the main charge, to initiate a detonation wave directed at the tubular member. A layer of dense medium is provided to confine the non-coupled surface of the charge and retard venting of explosive gases away from the tubular member. In the end result, concentrated, converging pressure pulses are applied to the tubular member on detonation, to cause it to be symmetrically crimped to restrict the passageway. U.S. Pat. No. 5,253,585 is herein incorporated by reference in its entirety.

U.S. Pat. No. 7,779,760 discloses a shaped charge assembly that comprises a housing, first shaped charge, a wave shaping relay charge and a second shaped charge located in the housing. The assembly is configured such that a first active element formed by initiation of the first shaped charge causes detonation of the wave shaping relay charge, which in turn causes initiation of the second shaped charge to form a second active element. The first active element moves beyond a second end of the housing to cause damage of a first kind to an external target and the second active element also moves beyond the second end to cause damage of a second kind to the target. Shaped charges are known in the art, and U.S. Pat. No. 7,779,760 is one example. U.S. Pat. No. 7,779,760 is herein incorporated by reference in its entirety.

U.S. Pat. No. 4,602,794 discloses an annular blowout preventer for use on an oil or gas well rig having a lower housing, an upper housing, a resilient sealing means, a vertical bore coaxially positioned through the housing and a vertically acting piston for actuating the sealing means in which the inner surface of the upper housing and the inner surface of the lower housing are concentric spherical surfaces extending to the bore. The resilient sealing means includes steel segments extending between the top and bottom of the sealing means and the top and bottom of the sealing means and the steel segments have spherical surfaces coacting with the spherical surfaces on the upper and lower housings. The upper and lower housings each include a vertical wall extending downwardly from the spherical surfaces on the upper and lower housing and the vertical moving piston sealingly engages the vertical walls. U.S. Pat. No. 4,602,794 is herein incorporated by reference in its entirety.

U.S. Pat. No. 7,354,026 discloses a unitary blade seal for a shearing blind ram of a ram-type blowout preventer and includes an elongate member having a generally semi-circular cross section with a curved upper surface and a lower surface. The lower surface has a pair of laterally extending sides that taper outwardly and have a metal outer cap bonded thereto. The metal outer caps form an acute angle that engages a complementary groove formed in the upper ram of the shearing blind ram assembly. U.S. Pat. No. 7,354,026 is herein incorporated by reference in its entirety.

U.S. Pat. No. 5,251,702 discloses a surface controlled, subsurface safety valve in which a force due to control pressure fluid from a first source at the surface for opening the valve is opposed in part by a force due to reference pressure fluid from a second source at the surface, whereby the valve closes in response to a fail condition. U.S. Pat. No. 5,251,702 is herein incorporated by reference in its entirety.

There is a need in the art for one or more of the following:

Improved systems and methods for controlling oil and gas spilling from a well;

Improved systems and methods for remotely controlling oil and gas spilling from a well;

Improved systems and methods for remotely controlling oil and gas spilling from a well when in emergency situations; and/or Improved systems and methods for remotely controlling oil and gas spilling from a well when obstructions are present in the wellbore.

SUMMARY OF THE INVENTION

One aspect of the invention provides a collapsible casing device, comprising an insert housing, said insert housing having an outer surface and an inner surface, said outer surface fluidly isolated from an external environment, said inner surface having a profile, and a connection between said outer surface and said inner surface, wherein said connection is capable of fluidly connecting to a tubular element; a deformable insert, said deformable insert having an inner surface and an outer surface, said outer surface fitting within said profile of said insert housing, said inner surface capable of containing a fluid and having a first inner diameter, said deformable insert having properties that are conducive to deformation; an explosive material that generates a pressure pulse in response to an activation signal, said explosive material having an inner surface and an outer surface and a composition, said outer surface fitting within said profile of said insert housing, said inner surface external to said outer surface of said deformable insert; and a trigger, said trigger capable of generating said activation signal.

Another aspect of the invention provides a method for controlling flow, comprising providing a collapsible casing device, said collapsible casing device having an insert housing, an explosive material, a deformable insert having an inner diameter, and a trigger; providing a first tubular element and a second tubular element; installing said collapsible casing device between said first tubular element and said second tubular element; lowering said first tubular element containing said collapsible casing device and said second tubular element to a selected location in a wellbore; and securing said first tubular element, said collapsible casing device, and said second tubular element within said wellbore.

BRIEF DESCRIPTION OF THE DRAWINGS

So that the features and advantages of the present invention can be understood in detail, a more particular description of the invention may be had by reference to the embodiments thereof that are illustrated in the appended drawings. These drawings are used to illustrate only typical embodiments of this invention, and are not to be considered limiting of its scope, for the invention may admit to other equally effective embodiments. The figures are not necessarily to scale and certain features and certain views of the figures may be shown exaggerated in scale or in schematic in the interest of clarity and conciseness.

DETAILED DESCRIPTION

Presently preferred embodiments of the invention are shown in the above-identified figures and described in detail below. Embodiments may be described with reference to certain features and techniques for use on wells in a subsea environment.

Figure 1:
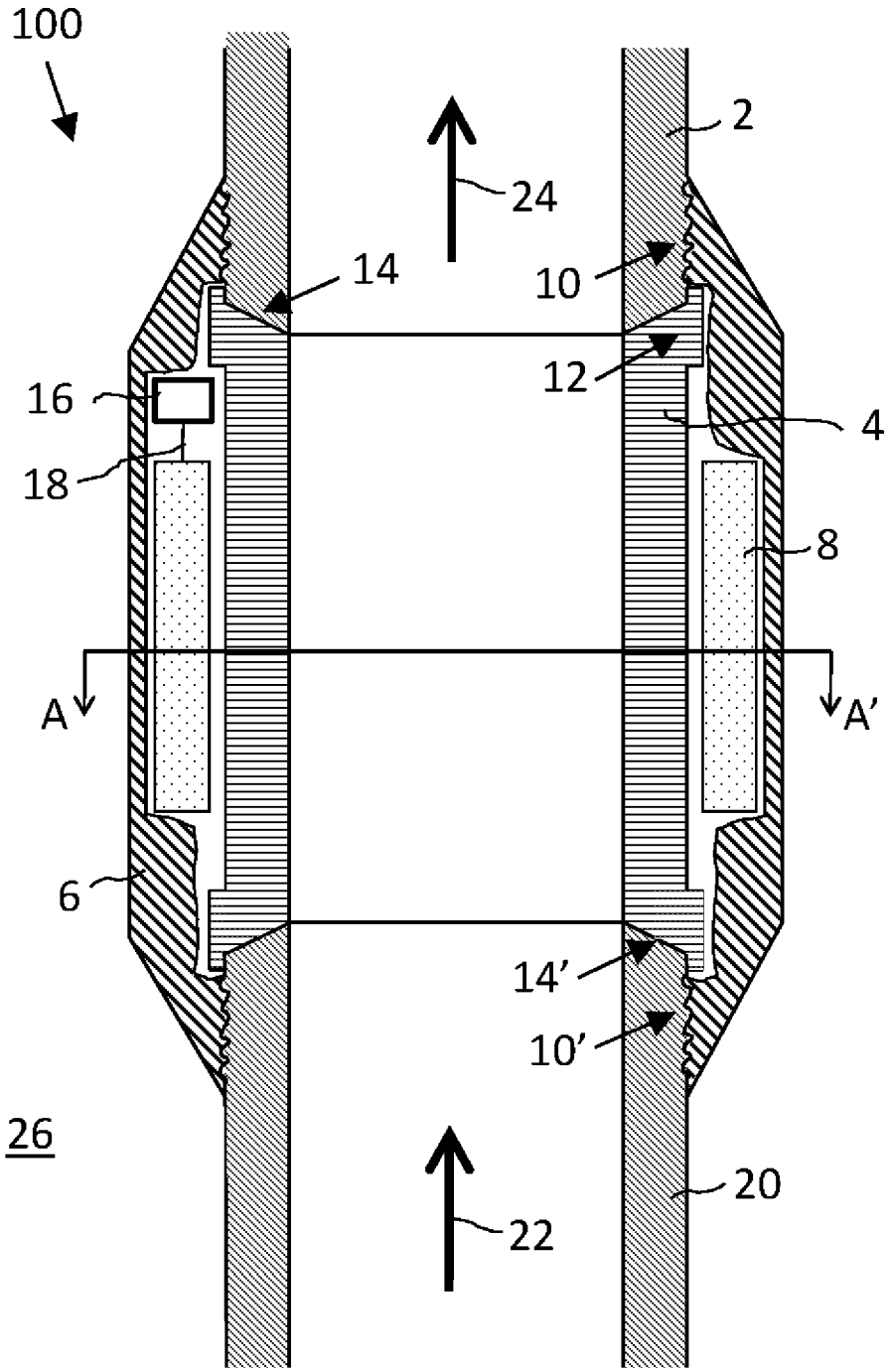
FIG. 1 is a schematic diagram of the initial condition of the collapsible casing device.

FIG. 1:

FIG. 1 is a schematic diagram of the initial condition of collapsible casing device 100. The outer surface of upper tubular 2 is rotatably connected to the outer or inner surface of insert housing 6. The outer surface of upper tubular 2 may be fluidly isolated from external environment 26.

Insert housing 6 may be a common steel used in oilfield tubulars, such as N-80 or P-110, and may be as strong as or stronger in tension, compression, burst, or torque than the upper tubular 2 or lower tubular 20, although one of skill in the art may appreciate that there are instances where insert housing 6 may be weaker in some regard than the surrounding material. Insert housing 6 contains a void capable of receiving explosive material 8 and deformable insert 4. Insert housing 6 may also contain an additional void for receiving trigger 16 and signal wire 18. Insert housing 6 may contain additional voids to allow for thermal expansion of contained materials, insulation, insulating fluid, shock absorbers, O-rings, pressure containment devices, temperature or pressure sensors, etc. The outer surface of insert housing 6 may be fluidly isolated from external environment 26. Any indications of a void shown on FIG. 1 are merely illustrational and should not be taken to indicate the present invention. Insert housing 6 may be less than 40 feet, such as less than 20 feet, such as 10 feet. Insert housing 6 extends from a first rotatable connection 10 to a second rotatable connection 10'.

Rotatable connection 10 may be a threaded connection as is known in the art, wherein the outer surface of upper tubular 2 forms a pin end and the inner surface of insert housing 6 forms a box end. Rotatable connection 10 may also contain an O-ring, a plastic back up ring, a viscous fluid, etc. Rotatable connection 10 may be as strong as or stronger than the surrounding material, although one of skill in the art may appreciate that there are instances where rotatable connection 10 may be weaker than the surrounding material. Rotatable connection 10 may be fluidly isolated from external environment 26. Rotatable connection 10 may also be a metal-to-metal seal, a snap ring, a weld, or any other method of fastening together two substantially cylindrical metal objects.

Upper tubular 2 sealingly engages deformable insert 4 at sealing face 14. Sealing face 14 may be a metal-to-metal seal, a metal seal with an O-ring insert, a metal seal with a viscous fluid, or any other seal as is known in the art. Sealing face 14 may be fluidly isolated from external environment 26. Although sealing face 14 is shown with a beveled edge, sealing face 14 may be a blunt edge, a rounded edge, or any other edge as is known in the art.

Deformable insert 4 is contained within insert housing 6. Deformable insert 4 extends from a first sealing face 14 to a second sealing face 14' such that the minimum inner diameter of deformable insert 4 may be at least as large as the minimum inner diameter of upper tubular 2 or lower tubular 20. Lower tubular 20 begins at second sealing face 14' and extends into the well and is connected to insert housing 6 by rotatable connection 10'. Lower tubular 20 may be similar to upper tubular 2, discussed above. One of skill in the art may appreciate that there are instances where the minimum inner diameter of deformable insert 4 may be smaller than the minimum inner diameter of upper tubular 2 or lower tubular 20. Deformable insert 4 may be a material that will collapse preferential to the surrounding upper tubular 2, insert housing 6, or lower tubular 20, such as copper, a copper-alloy, a mild steel, etc. Deformable insert 4 may contain etchings, depressions, indentions, etc. on the outer surface to create localized pressure points and lead to a controlled collapse. Deformable insert 4 may have concentrations of material 12 at the upper or lower end so as to reduce the deformation at the upper or lower end, which may make future recovery operations easier. Deformable insert 4 may also protect explosive material 8, trigger 16, or signal wire 18 from damage due to traditional well completion and workover activities. Testing may be performed on various deformable inserts 4 to determine the preferred design to optimize or predict folding properties.

Explosive material 8 is located between the inner surface of insert housing 6 and the outer surface of deformable insert 4. Explosive material 8 may extend radially about insert housing 6 such that explosive material 8 has a disc or cylindrical shape. The void between the inner surface of explosive material 8 and the outer surface of deformable insert 4, or the void between the outer surface of explosive material 8 and the inner surface of insert housing 6, may be dependent on the materials used, pressures, temperatures, application, etc. The composition of explosive material 8 may be based on High Melting Explosive (HMX), Cyclotrimethylenetrinitramine (RDX), Hexanitrostilbene (HNS), Pentaerythritol tetranitrate (PETN), or any other explosive material known in the art. The composition, amount, or subsequent shape or design of explosive material 8 may be determined for a given application based on pressure, temperature, casing weight, wall thickness, deformable insert 4 thickness, etc. The rectangular shape of explosive material 8 shown in FIG. 1 is purely illustrational and should not indicate a rectangular or straight edged shape is required. Explosive material 8 may be designed such that the pressure wave travels inward to collapse deformable insert 4 while leaving insert housing 6 substantially undeformed.

Trigger 16 may provide the initial energy to activate explosive material 8. Trigger 16 may be connected to explosive material 8 by signal wire 18. Signal wire 18 may transmit a signal from trigger 16 to explosive material 8. Trigger 16 and signal wire 18 may be contained within insert housing 6, although one of skill in the art can appreciate that trigger 16 may be partially contained within insert housing 6 or external to insert housing 6 depending on the application.

It may be desired that collapsible casing device 100 has rotational symmetry, with possible exception to trigger 16 and signal wire 18. Produced fluids, which may include oil, gas, water, chemicals, suspended sand, suspended proppant, scale, etc. pass within the void defined by the inner surfaces of lower tubular 20, deformable insert 4, and upper tubular 2 in the direction marked by arrows 22 and 24. Rotatable connection 10, sealing faces 14 and 14', the inner surfaces of lower tubular 20, deformable insert 4, and upper tubular 2, etc. may all be designed to fluidly isolate the produced fluids from external environment 26. While in non-activated mode, the produced fluid flow rate entering deformable insert 4, represented by arrow 22, may be equal to the produced fluid flow rate exiting deformable insert 4, represented by arrow 24.

In some cases, upper tubular 2 and lower tubular 20 may be short pieces of tubular known as "pup joints" or "pups" and may be temporarily or permanently affixed to collapsible casing device 100. The "pups" and collapsible casing device 100 are commonly known as an "assembly." These "pups" may have rotatable connections 10 on the ends opposite collapsible casing device 100 that allow the entire "assembly" to be rotatably connected to the existing tubular string. This may reduce the length of time needed to integrate collapsible casing device 100 into the existing tubular string.

Figure 2:
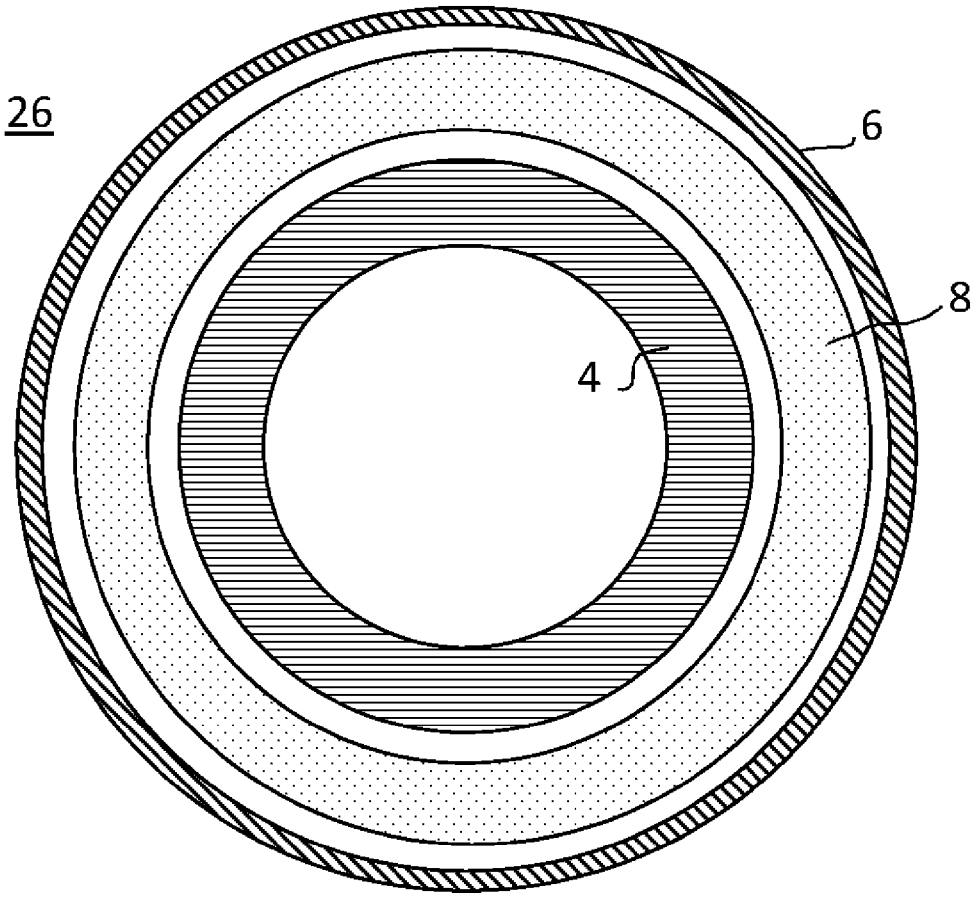
FIG. 2 is a cross-sectional view of the initial condition of the collapsible casing device shown in FIG. 1.

FIG. 2:

FIG. 2 is a cross-sectional view through the line A-A' of FIG. 1 and shows the initial condition of collapsible casing device 100. Only those items which differ from FIG. 1 will be discussed herein, remaining features are more fully explained with respect to FIG. 1.

Deformable insert 4 is contained within insert housing 6. Explosive material 8 is located between the inner surface of insert housing 6 and the outer surface of deformable insert 4.

Explosive material 8 may extend radially about insert housing 6 such that explosive material 8 has a disc or cylindrical shape. Alternatively, explosive material 8 may extend radially about a first circumference of insert housing 6 but not along a second circumference of insert housing 6, such that explosive material 8 is selectively included within insert housing 6. The void between the inner surface of explosive material 8 and the outer surface of deformable insert 4, or the void between the outer surface of explosive material 8 and the inner surface of insert housing 6, may be dependent on the materials used, pressures, temperatures, application, etc.

Figure 3:
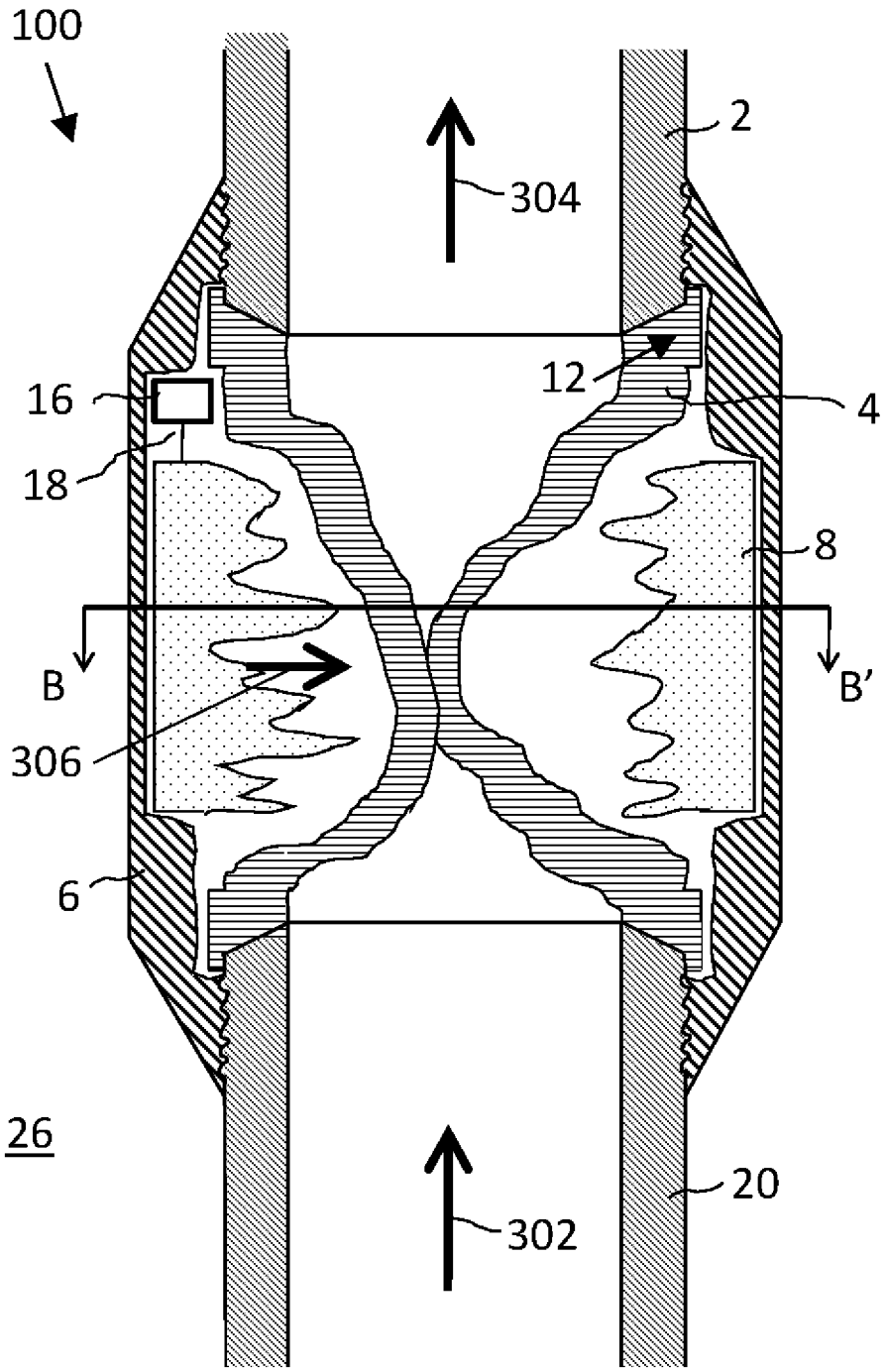
FIG. 3 is a schematic diagram of the activated condition of the collapsible casing device.

FIG. 3:

FIG. 3 is a schematic diagram of activated collapsible casing device 100. Only those items which differ from FIG. 1 will be discussed herein, remaining features are more fully explained with respect to FIG. 1.

When trigger 16 is activated, a signal may travel through signal wire 18 to activate explosive material 8. Explosive material 8 may be designed such that a large pressure surge is created. The large pressure surge may travel radially inward towards the outer surface of deformable insert 4, as shown by arrow 306. Deformable insert 4 may absorb the energy by changing shape in such a way that the minimum inner diameter of deformable insert 4 is reduced. Explosive material 8 may be sized such that a substantial portion of the produced energy is absorbed by deformable insert 4, deforming deformable insert 4, while leaving insert housing 6 substantially undeformed.

It may be desired that deformed deformable insert 4 has rotational symmetry. This may be done by modifying deformable insert 4, as discussed in reference to FIG. 1. Produced fluids pass through the void defined by the inner surface of lower tubular 20 and encounter the reduced minimum inner diameter of deformed deformable insert 4. The minimum inner diameter of deformable insert 4 may be partially to fully reduced such that deformable insert 4 acts as a flow restriction. The produced fluid flow rate entering deformable insert 4, represented by arrow 302, may be less than the produced fluid flow rate exiting deformable insert 4, represented by arrow 304. Although FIG. 3 indicates the minimum inner diameter of deformable insert 4 is fully reduced at some location along the length of deformable insert 4, this should not be taken to indicate that a partially reduced minimum inner diameter is excluded from the present invention.

Produced fluids remain fluidly isolated from external environment 26 by lower tubular 20, insert housing 6, and upper tubular 2. As discussed in reference to FIG. 1, insert housing 6 may be as strong as or stronger in tension, compression, burst, or torque than the upper tubular 2 or lower tubular 20, although one of skill in the art may appreciate that there are instances where insert housing 6 may be weaker in some regard than the surrounding material. In this way, although deformable insert 4 may be deformed, and explosive material 8 may be consumed, full strength is retained within the system.

In another embodiment of the present invention, trigger 16 or signal wire 18 may be modified or pre-programmed such that explosive material 8 is activated by a remotely generated signal. This signal may be sent in an emergency situation or when certain well parameters have been exceeded. Trigger 16 or signal wire 18 may be modified or programmed to activate selectively in response to time, pressure, temperature, density, flow rate, etc. Trigger 16 or signal wire 18 may use a control loop to detect deviation from a baseline parameter, or to detect deviation for a certain length of time. Trigger 16 or signal wire 18 may also be modified or programmed to terminate the activation sequence, be reset, or be completely disarmed.

Alternatively, trigger 16 or signal wire 18 may modified or pre-programmed such that explosive material 8 is activated by a differential pressure. This may be a natural differential pressure, such as a differential pressure created when certain parameters are outside an acceptable range. This may allow for a fully automatic system. Alternatively, it may be an artificial differential pressure applied intentionally during a workover or well control operation.

In this way, collapsible casing device 100 may be installed during initial drilling and completion operations or during a workover. Collapsible casing device 100 may remain in the well indefinitely, without affecting produced fluid flow, wellbore integrity, or wellbore usability. Collapsible casing device 100 may be activated only when desired, or may never be activated, and may be removed when the wellbore is decommissioned.

Deformable insert 4 or explosive material 8 may be designed such that the upper or lower sections of deformable insert 4 contain concentrations of material 12, as discussed in reference to FIG. 1. Deformable insert 4 may be left substantially undeformed near the upper or lower concentrations of material 12. This may allow oilfield tools to be run into the upper portion of deformable insert 4 to partially or fully increase the minimum inner diameter of deformable insert 4 after a collapse. These tools may include a smaller diameter workstring, swedging tools, milling tools, broaches, etc. Alternatively, tools may be run that latch on to the upper portion of deformable insert 4 and apply tensile forces or compressive forces to pull or push deformable insert 4 into or out of the wellbore. Alternative tools may be run to latch on to the upper portion of deformable insert 4 and perform remedial well workover operations as are known in the art.

Figure 6:
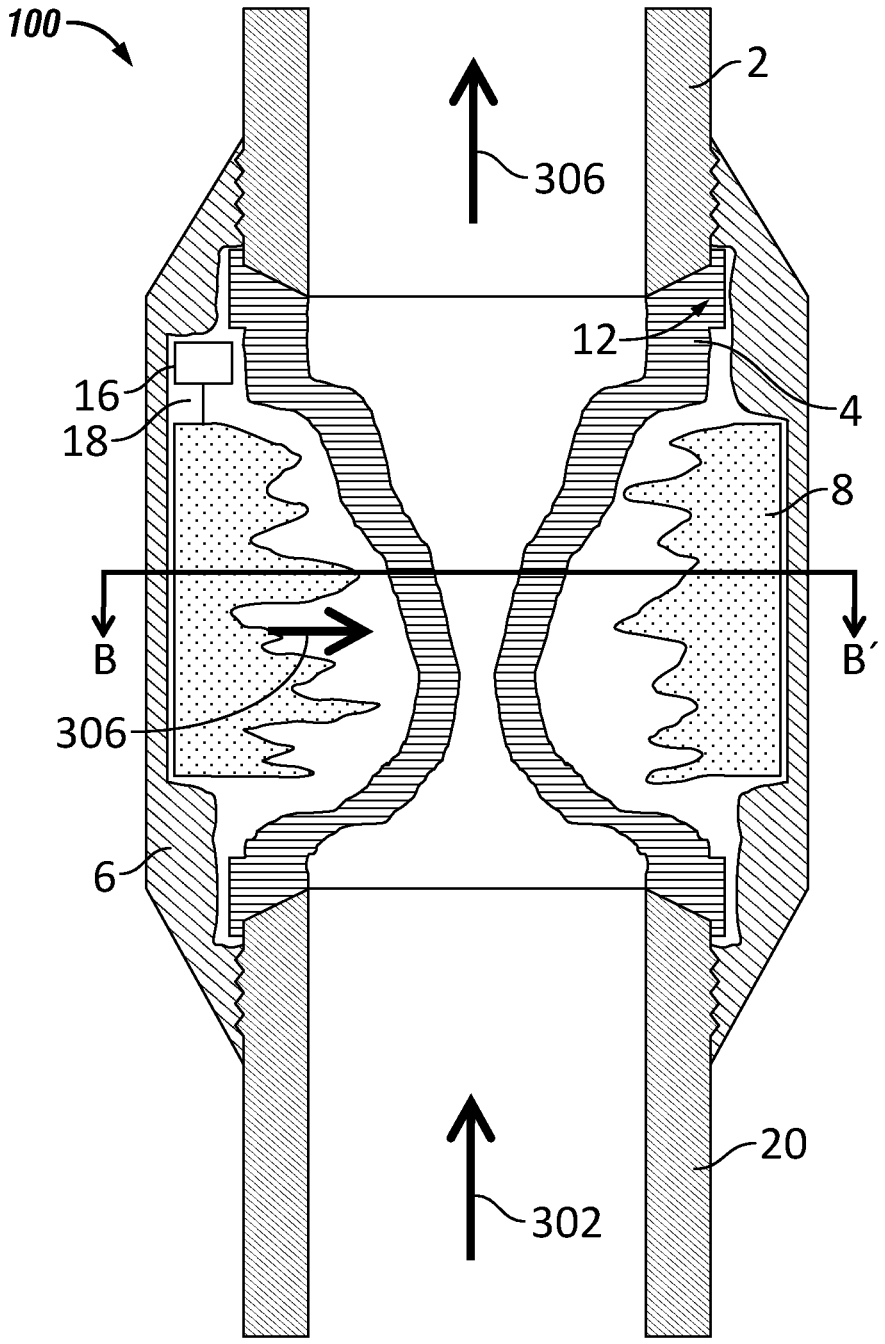
FIG. 6 is a schematic diagram of the collapsible casing device with an increased inner diameter.

FIG. 6 illustrates collapsible casing device 100 after the minimum inner diameter of deformable insert 4 has been increased after a collapse.

Figure 4:
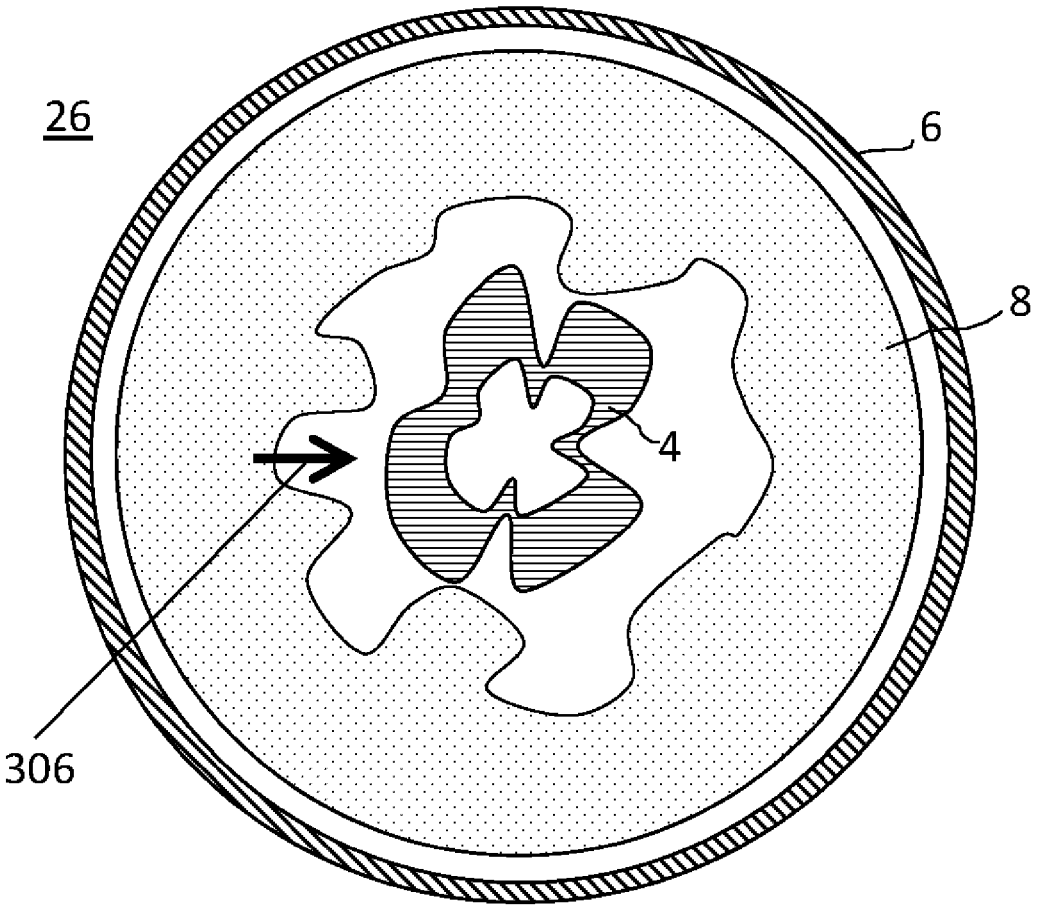
FIG. 4 is a cross-sectional view of the activated condition of the collapsible casing device shown in FIG. 3.

FIG. 4:

FIG. 4 is a cross-sectional view through the line B-B' of FIG. 3 and shows the activated condition of collapsible casing device 100. Only those items which differ from FIGS. 1-3 will be discussed herein, remaining features are more fully explained with respect to FIGS. 1-3.

Explosive material 8 has been activated. Explosive material 8 may be designed such that a large pressure surge is created. The large pressure surge has travelled radially inward towards the outer surface of deformable insert 4, as shown by arrow 306. Deformable insert 4 has absorbed the energy by changing shape in such a way that the minimum inner diameter of deformable insert 4 is reduced. Explosive material 8 may be sized such that a substantial portion of the produced energy is absorbed by deformable insert 4, deforming deformable insert 4, while leaving insert housing 6 substantially undeformed. FIG. 4 illustrates one potential path of explosive material 8, but is may be understood by one skilled in the art that at least a portion of explosive material 8 may be consumed to create the pressure wave, or the outer surface and inner surface of explosive material 8 may be consumed or substantially altered.

Deformable insert 4 remains contained within insert housing 6. Deformable insert 4 now presents a flow restriction to reduce the flow rate of the produced fluids through deformable insert 4.

Figure 5:
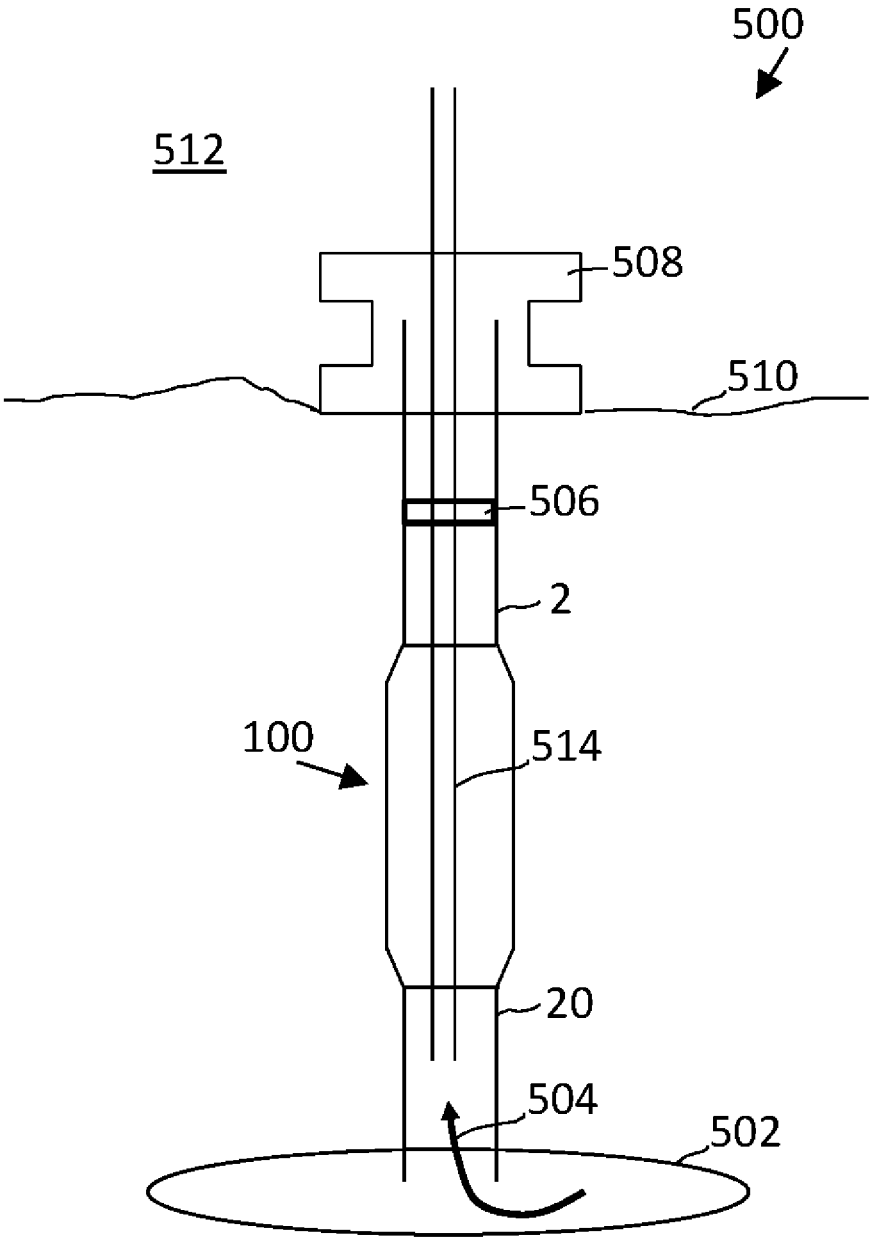
FIG. 5 is a schematic diagram of the collapsible casing device positioned above a subsea well.

FIG. 5:

FIG. 5 is a schematic diagram of wellsite 500. Only those items which differ from FIGS. 1-4 will be discussed herein, remaining features are more fully explained with respect to FIGS. 1-4. Lower tubular 20 is connected to reservoir 502. Produced fluid flows from reservoir 502 into lower tubular 20 in the direction of arrow 504. Collapsible casing device 100 may be fluidly connected to lower tubular 20 and upper tubular 2. Additional wellbore jewelry 506 may be contained in upper tubular 2, such jewelry 506 may be a surface controlled subsurface safety valve (SCSSV). Upper tubular 2 is connected to wellhead 508. Wellhead 508 may be located on surface 510. Environment 512 may be the sea, a lake, air, etc. depending on the location of wellsite 500.

Collapsible casing device 100 may be self-contained and unobtrusive in the tubular string and may be integrated into traditional tubular strings. Collapsible casing device 100 may be located below jewelry 506, and may be located at a depth between 250 feet and 2500 feet below the wellhead, such as at a depth between 400 feet and 1000 feet, such as at 500 feet. Jewelry 506 may contain external control lines, such as in the case of SCSSVs, and it may be desirable to install collapsible casing device 100 in a portion of the tubular string that does not contain external control lines. Collapsible casing device 100 may be installed at a depth determined by the given wellsite 500 design to increase the likelihood that any flow to be controlled is located between collapsible casing device 100 and reservoir 502.

Collapsible casing device 100 may be designed such that in the event that wellsite 500 is in workover mode and a workstring 514 is run from surface and passes across collapsible casing device 100, deformable insert 4 will collapse onto the outer surface of workstring 514. The minimum inner diameter of workstring 514 would remain substantially unaltered. Alternatively, collapsible casing device 100 may be designed such that deformable insert 4 will collapse onto the outer surface of workstring 514 such that a portion of workstring 514 itself will also collapse and reduce the minimum inner diameter of workstring 514. In both of these forms, at least a partial flow restriction may be introduced to restrict the flow rate of produced fluid from reservoir 502.

As discussed in reference to FIGS. 1-4, collapsible casing device 100 may be remotely activated or deactivated for the life cycle of the well. Unlike jewelry 506, collapsible casing device 100 may operate without the need for control wires or hydraulic lines. Collapsible casing device 100 may arrive on location already rotatably connected to a section of upper tubular 2 and lower tubular 20 such that collapsible casing device 100 is easy to install in the full tubular string and requires no additional tools.

Illustrative Embodiments

In one embodiment, there is disclosed a collapsible casing device, comprising an insert housing, said insert housing having an outer surface and an inner surface, said outer surface fluidly isolated from an external environment, said inner surface having a profile, and a connection between said outer surface and said inner surface, wherein said connection is capable of fluidly connecting to a tubular element; a deformable insert, said deformable insert having an inner surface and an outer surface, said outer surface fitting within said profile of said insert housing, said inner surface capable of containing a fluid and having a first inner diameter, said deformable insert having properties that are conducive to deformation; an explosive material that generates a pressure pulse in response to an activation signal, said explosive material having an inner surface and an outer surface and a composition, said outer surface fitting within said profile of said insert housing, said inner surface external to said outer surface of said deformable insert; and a trigger, said trigger capable of generating said activation signal. In some embodiments, said trigger comprises a receiver for accepting an incoming signal. In some embodiments, the device further comprises a tubular element fluidly connected to said insert housing, said tubular element comprising an inner surface and an outer surface, and a diameter of said inner surface. In some embodiments, the device further comprises a signal wire for transmitting said activation signal to said explosive material. In some embodiments, said deformable insert further comprises a sealing face, said sealing face fluidly abutted to said tubular element. In some embodiments, the device further comprises a concentration of material at a specific location to improve deformation characteristics. In some embodiments, said deformable insert further comprises defects, said defects causing said deformable insert to deform in a predictable manner. In some embodiments, said deformable insert first inner diameter is at least as great as said tubular element inner diameter. In some embodiments said composition of said explosive material is determined based on said external environment. In some embodiments, said tubular element is connected to said insert housing by a threaded connection.

In one embodiment, there is disclosed a method for controlling flow, comprising providing a collapsible casing device, said collapsible casing device having an insert housing, an explosive material, a deformable insert having an inner diameter, and a trigger; providing a first tubular element and a second tubular element; installing said collapsible casing device between said first tubular element and said second tubular element; lowering said first tubular element containing said collapsible casing device and said second tubular element to a selected location in a wellbore; and securing said first tubular element, said collapsible casing device, and said second tubular element within said wellbore. In some embodiments, the method also includes activating said trigger. In some embodiments, the method also includes sending a signal from said trigger to said explosive material, wherein said signal causes said explosive material to generate a pressure pulse that extends radially inward towards said deformable insert. In some embodiments, the method also includes deforming said deformable insert, wherein said inner diameter of said deformable insert is reduced. In some embodiments, the method also includes flowing a produced fluid up said wellbore at a first flow rate. In some embodiments, the method also includes deforming said deformable insert, wherein said inner diameter of said deformable insert is reduced and said produced fluid flows at a second flow rate that is less than said first flow rate. In some embodiments, the method also includes increasing said inner diameter of said deformable insert after said inner diameter has been reduced. In some embodiments, in said installing step, said tubular elements and said collapsible casing device are fluidly connected. In some embodiments, said deformable insert further comprises defects, said defects causing said deformable insert to deform in a predictable manner.

It will be understood from the foregoing description that various modifications and changes may be made in the preferred and alternative embodiments of the present invention without departing from its true spirit.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A collapsible casing device, comprising:

an insert housing, said insert housing having an outer surface and an inner surface, said outer surface fluidly isolated from an external environment, said inner surface having a profile, and a connection between said outer surface and said inner surface, wherein said insert housing is capable of fluidly connecting to a tubular element;

a deformable insert, said deformable insert having an inner surface and an outer surface comprising etchings, depressions, or indentions, said outer surface fitting within said profile of said insert housing, said inner surface capable of containing a fluid and having a first inner diameter, said deformable insert comprising a material selected from the group consisting of copper, a copper-alloy, and a mild steel, wherein said deformable insert further comprises a concentration of material at a specific location to improve deformation characteristics;

an explosive material that generates a pressure pulse in response to an activation signal, said explosive material having an inner surface and an outer surface and a composition, said outer surface fitting within said profile of said insert housing, said inner surface external to said outer surface of said deformable insert; and a trigger, said trigger capable of generating said activation signal.

2. The collapsible casing device of claim 1, further comprising a tubular element fluidly connected to said insert housing, said tubular element comprising an inner surface and an outer surface, and a diameter of said inner surface.

3. The collapsible casing device of claim 1, further comprising a signal wire for transmitting said activation signal to said explosive material.

4. The collapsible casing device of claim 1, wherein said deformable insert further comprises a sealing face, said sealing face fluidly abutted to said tubular element.

5. The collapsible casing device of claim 2, wherein said deformable insert first inner diameter is at least as great as said tubular element inner diameter.

6. The collapsible casing device of claim 1, wherein said composition of said explosive material is determined based on said external environment.

7. The collapsible casing device of claim 2, wherein said tubular element is connected to said insert housing by a threaded connection.

8. A method for controlling flow, comprising:

providing a collapsible casing device, said collapsible casing device having an insert housing, an explosive material, a deformable insert having an inner diameter, and a trigger;

providing a first tubular element and a second tubular element;

installing said collapsible casing device between said first tubular element and said second tubular element;

lowering said first tubular element containing said collapsible casing device and said second tubular element to a selected location in a wellbore;

securing said first tubular element, said collapsible casing device, and said second tubular element within said wellbore;

deforming said deformable insert, wherein said inner diameter of said deformable insert is reduced; and increasing said inner diameter of said deformable insert after said inner diameter has been reduced.

9. The method of claim 8, further comprising activating said trigger.

10. The method of claim 8, further comprising sending a signal from said trigger to said explosive material, wherein said signal causes said explosive material to generate a pressure pulse that extends radially inward towards said deformable insert.

11. The method of claim 8, further comprising flowing a produced fluid up said wellbore at a first flow rate.

12. The method of claim 11, further comprising deforming said deformable insert, wherein said inner diameter of said deformable insert is reduced and said produced fluid flows at a second flow rate that is less than said first flow rate.

13. The method of claim 8, wherein in said installing step, said tubular elements and said collapsible casing device are fluidly connected.

14. The method of claim 8, wherein said deformable insert further comprises defects, said defects causing said deformable insert to deform in a predictable manner.

* * * * *